US007290807B2

(12) United States Patent
Kumar

(10) Patent No.: US 7,290,807 B2
(45) Date of Patent: Nov. 6, 2007

(54) METHOD AND SYSTEM OF LIMITING THE APPLICATION OF SAND TO A RAILROAD RAIL

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 277 days.

(21) Appl. No.: 11/059,910

(22) Filed: Feb. 17, 2005

(65) Prior Publication Data

US 2005/0140144 A1 Jun. 30, 2005

Related U.S. Application Data

(63) Continuation-in-part of application No. 10/606,722, filed on Jun. 26, 2003, now Pat. No. 6,893,058, and a continuation-in-part of application No. 10/606,723, filed on Jun. 26, 2003, now Pat. No. 7,152,888.

(60) Provisional application No. 60/419,673, filed on Oct. 18, 2002, provisional application No. 60/391,743, filed on Jun. 26, 2002.

(51) Int. Cl.
*B60B 39/00* (2006.01)

(52) U.S. Cl. ..... 291/2

(58) Field of Classification Search ..... 291/2, 291/12, 13, 25

See application file for complete search history.

(56) References Cited

U.S. PATENT DOCUMENTS 4,034,249 A 7/1977 Avery
4,184,434 A 1/1980 Chapin
4,792,462 A 12/1988 Smith et al.
5,446,389 A 8/1995 Lenz
5,613,444 A 3/1997 Ahmadian et al.
5,746,135 A 5/1998 Ahmadian et al.
6,006,674 A 12/1999 Ahmadian et al.
6,152,546 A 11/2000 Daigle
6,194,850 B1 2/2001 Kumar et al.

(Continued)

*Primary Examiner*—S. Joseph Morano
*Assistant Examiner*—Robert J. McCarry, Jr.
(74) *Attorney, Agent, or Firm*—Carlos Luis Hanze; Cian G. O'Brien; Beusse Wolter Sanks Mora & Maire, P.A.

(57) ABSTRACT

A method and computer program product of limiting sand use in a railroad locomotive sanding system applying sand to railroad rails to enhance adhesion of wheels of a railroad locomotive on a track having a pair of railroad rails, the sanding system including a plurality of sand applicators for each rail for directing sand flow toward the rail and with the locomotive having two trucks carrying the wheels for supporting and propelling the locomotive along the track. The method and computer program product may include steps of automatically controlling a flow of sand applied to the rail by the locomotive sanding system to limit the application of sand to situations in which applying sand to the rail would be effective to increase the adhesion of at least one of the railroad locomotive wheels on the rail by a predetermined incremental amount. The operation of each of the plurality of sand applicators may be independently controlled for selectively operating those sand applicators whose operation will result in at least the predetermined incremental increase in adhesion of the locomotive wheels on the rail, while not operating the other sand applicators so as to limit the amount of sand applied to the track.

27 Claims, 9 Drawing Sheets

U.S. PATENT DOCUMENTS 6,208,097 B1 3/2001 Reddy et al.
6,262,573 B1 7/2001 Wojnarowski et al.
6,276,281 B1 8/2001 Mesalic et al.
6,499,815 B1 12/2002 Daigle
6,588,808 B1 7/2003 Sheppard
6,629,709 B1 * 10/2003 Tunley et al. ..... 291/2
2004/0060375 A1 4/2004 Kumar et al.
2004/0075280 A1 4/2004 Kumar et al.
2004/0133315 A1 7/2004 Kumar et al.

* cited by examiner

METHOD AND SYSTEM OF LIMITING THE APPLICATION OF SAND TO A RAILROAD RAIL

CROSS REFERENCE TO RELATED APPLICATIONS

This application is a continuation-in-part of U.S. application Ser. No. 10/606,722 filed on Jun. 26, 2003 now U.S. Pat. No. 6,893,058 which claims the benefit of provisional Application No. 60/419,673 filed on Oct. 18, 2002 and is a continuation-in-part of U.S. application Ser. No. 10/606,723 filed on Jun. 26, 2003 now U.S. Pat. No. 7,152,888 which claims the benefit of provisional Application No. 60/391,743 filed on Jun. 26, 2002 U.S. application Ser. No. 10/606,722 and U.S. application Ser. No 10/606,723 are incorporated herein by reference.

FIELD OF THE INVENTION

The invention relates generally to railroad friction enhancing systems and more particularly methods and systems for automatically limiting the amount of sand applied a railroad rail for enhancing the adhesion between locomotive wheels and the rail.

BACKGROUND OF THE INVENTION

Locomotives and transit vehicles as well as other large traction vehicles are commonly powered by electric traction motors coupled in driving relationship to one or more axles of the vehicle. Locomotives and transit vehicles generally have at least four axle-wheel sets per vehicle with each axle-wheel set being connected via suitable gearing to the shaft of a separate electric motor commonly referred to as a traction motor. In the motoring mode of operation, the traction motors are supplied with electric current from a controllable source of electric power (e.g., an engine-driven traction alternator) and apply torque to the vehicle wheels which exert tangential force or tractive effort on the surface on which the vehicle is traveling (e.g., the parallel steel rails of a railroad track), thereby propelling the vehicle in a desired direction along the right of way.

Maximum tractive or braking effort is obtained if each powered wheel of the vehicle is rotating at such an angular velocity that its actual peripheral speed is slightly higher (motoring) than the true vehicle speed (i.e., the linear speed at which the vehicle is traveling, usually referred to as "ground speed" or "track speed"). The difference between tractive wheel speed and track speed is referred to as "creepage" or "creep speed." There is a variable value of creepage at which peak tractive effort is realized. This value, commonly known as the optimal creep setpoint is a variable that depends on track speed and rail conditions. So long as the allowable creepage is not exceeded, this controlled wheel slip is normal and the vehicle will operate in a stable microslip or creeping mode. If wheel-to-rail adhesion tends to be reduced or lost, some or all of the tractive wheels may slip excessively, i.e., the actual creep speed may be greater than the maximum creep speed. Such a gross wheel slip condition, which is characterized in the motoring mode by one or more spinning axle-wheel sets, can cause accelerated wheel wear, rail damage, high mechanical stresses in the drive components of the propulsion system, and an undesirable decrease of tractive effort.

The peak tractive effort limits the pulling/braking capability of the locomotive. This peak tractive effort is a function of various parameters, such as weight of the locomotive per axle, wheel rail material and geometry, and contaminants like snow, water, grease, insects and rust. Contaminants in the wheel/rail interface reduce the maximum adhesion available, even at the optimal creep setpoint.

Locomotives used for heavy haul applications typically must produce high tractive efforts. Good adhesion between each wheel and the surface of a railroad rail contributes to the efficient operation of the locomotive. The ability to produce high tractive efforts depends on the available or potential adhesion between the wheel and rail. Many rail conditions such as being wet or covered with snow or ice require an application of friction enhancing agent such as sand to improve or enhance the adhesion of the wheel to the rail. Therefore, locomotives typically have sand boxes on either end of the locomotives, and nozzles to dispense the sand to the rail on either side of a locomotive truck.

Locomotives may enhance the adhesion between their wheels and the railroad rail by initiating a flow of sand from the sand boxes to the rail surface. The flow of sand may be initiated in response to one or more conditions being met such as one or more wheel axels slipping. When such condition is met, typical sanding systems will activate a flow of sand through two sand applicators located in front of each of two locomotive trucks when the locomotive is moving forward. Sand is thus dispensed at a fixed rate through four sand applicators each time there is a demand for sanding from the locomotive controller. Sand is typically dispensed for a set period of time, which frequently results in more sand being dispensed than necessary to maximize adhesion between the locomotive wheels and the railroad rail.

Dispensing more sand than is necessary is wasteful and may cause sand to be delivered to areas that are undesirable. For example, typical systems that automatically or manually dispense sand in response to a condition being met may cause sand to get into switches, track circuits or drains, for example, which may damage equipment or lead to malfunctions.

BRIEF DESCRIPTION OF THE INVENTION

Therefore, there is a need for an improved system and method for automatically controlling the application of sand to the rail by railway locomotives. Such a system and method monitors and assesses various factors and parameters for the purpose of limiting the amount of sand dispensed for enhancing adhesion between locomotive wheels and the surface of a railroad rail. The amount of sand applied to a rail may be limited by monitoring operational parameters of a locomotive and discontinuing or reducing a flow of sand based on those operational parameters.

DETAILED DESCRIPTION OF THE INVENTION

Figure 1:
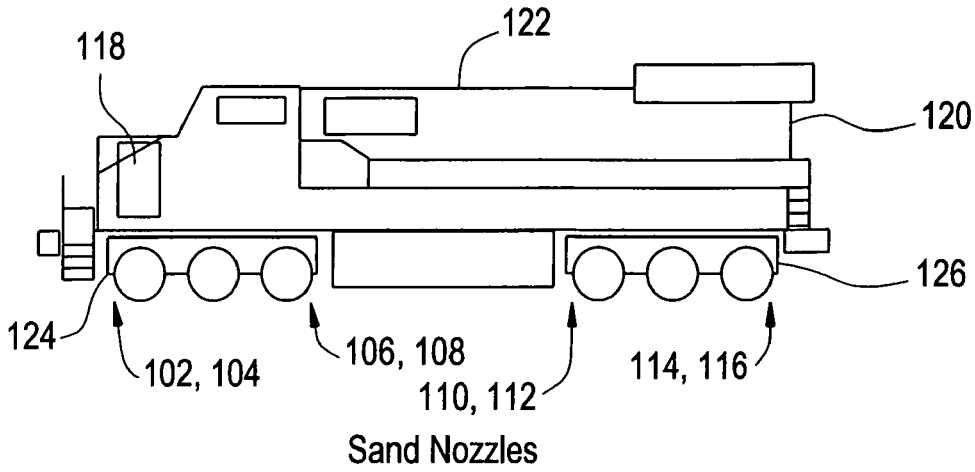
FIG. 1 is a schematic illustration of a locomotive having a sanding system for dispensing sand.

FIG. 1 illustrates a 122 locomotive configured with an exemplary sanding system for limiting the application of sand to railroad rails. Sand may be stored in a front sand box 118 or a rear sand box 120. The illustrated embodiment includes eight sand applicators or nozzles 102-116. Locomotive 122 may have two trucks 124, 126. Front truck 124 may include one sand nozzle in the front left 102, one in the front right 104, one in the rear left 106, and one in the rear right 108. Rear truck 126 may include one sand nozzle in the front left 110, one in the front right 112, one in the rear left 114, and one in the rear right 116. Alternate embodiments may include more or less than the eight illustrated nozzles 102-116 including nozzles located on other locomotives in a train consist.

Figure 2:
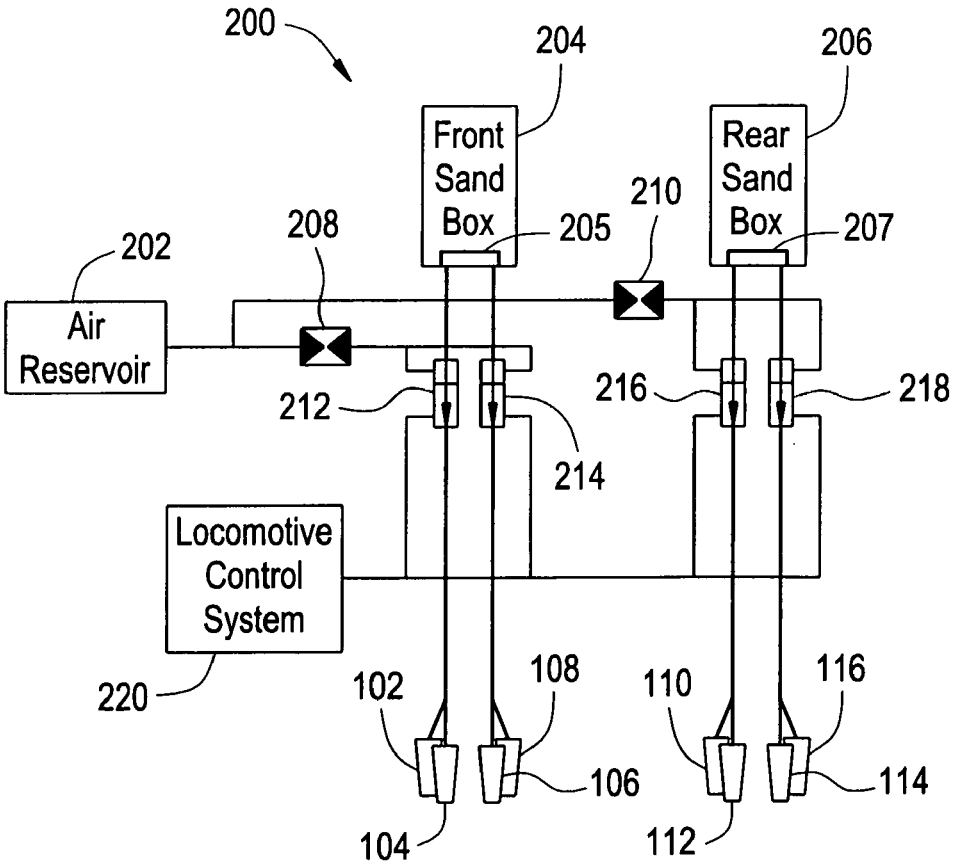
FIG. 2 is a schematic of the sanding system of FIG. 1.

FIG. 2 illustrates a schematic diagram of the exemplary sanding system 200 of FIG. 1. The exemplary system 200 may include a front sand box 204 and a rear sand box 206 for supplying sand to nozzles 102-116, respectively. A compressed air reservoir 202 may supply compressed air to air valves 208, 210. A pair of electrically controlled sand valves 212, 214 may be provided for front truck 124, and similar valves 216, 218 may be provided for rear truck 126. Valves 212, 214 may control sand flow through respective nozzles 102-108 and valves 216, 218 may control sand flow through respective nozzles 110-116. A locomotive control system 220 may be configured to control air reservoir 202, air valves 208, 210, and sand valves 212-218 for limiting the application of sand to railroad rails.

Figure 3:
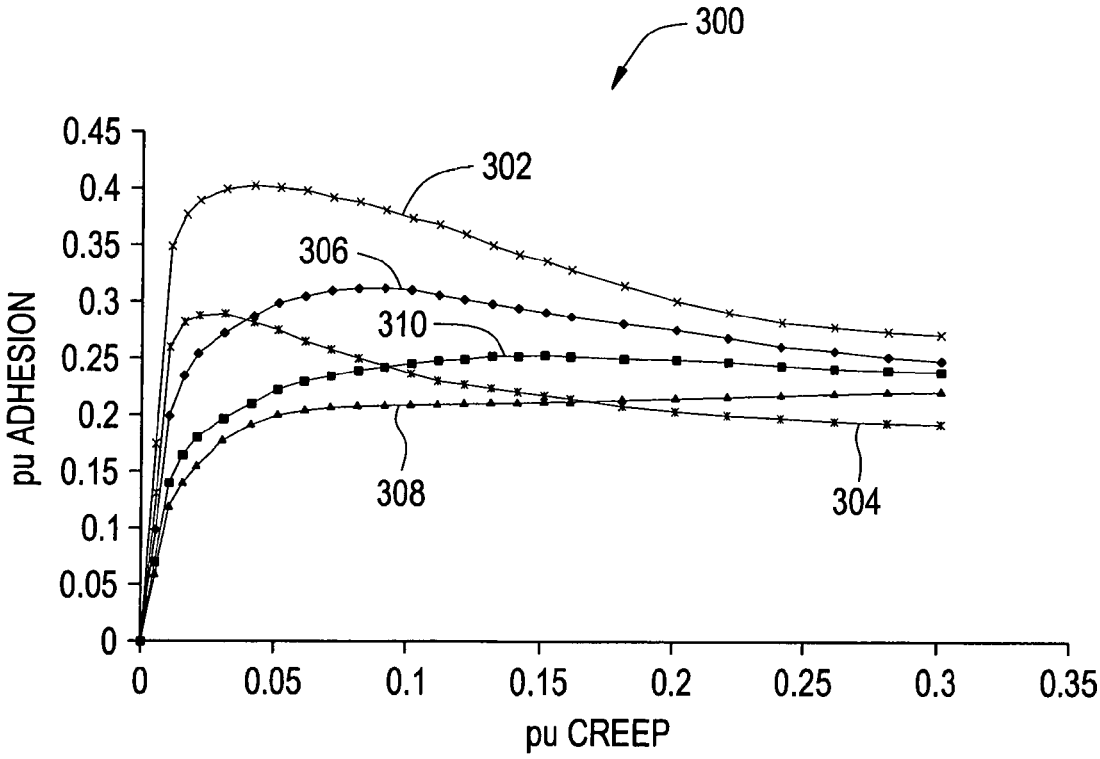
FIG. 3 illustrates exemplary adhesion versus creep curves for different rail conditions and friction modifying agents.

FIG. 3 illustrates an exemplary adhesion creep curve 300 for a locomotive traversing a rail. As illustrated, curve 302 depicts the per unit of adhesion levels of dry sand vs. per unit of creep. Dry sand provides the highest levels of adhesion for each level of per unit creep at per unit creep levels of less than 0.3. For per unit of creep levels of less than about 0.05, wet sand as depicted by curve 304 provides a higher adhesion than a dry rail as shown by curve 306. However, at per unit creep levels greater than about 0.05, wet sand curve 304 has less adhesion than the dry rail curve 306. For situations where less adhesion is desirable, as is the case for connected railway cars or a locomotive rounding a curve in a track, oil as depicted by curve 308 provides the least amount of adhesion for per unit creep less than 0.1. Curve 310 illustrates the adhesion characteristics of water that also provides improved reduced friction as compared to a dry rail (curve 306) for per unit creep. From chart 300, it may be desirable to manage the friction between a wheel of a locomotive or a railway car and the railway rails in a manner that enhances the tractive effort of the locomotive while at the same time reducing the friction of railway cars connected to the locomotive.

Figure 4:
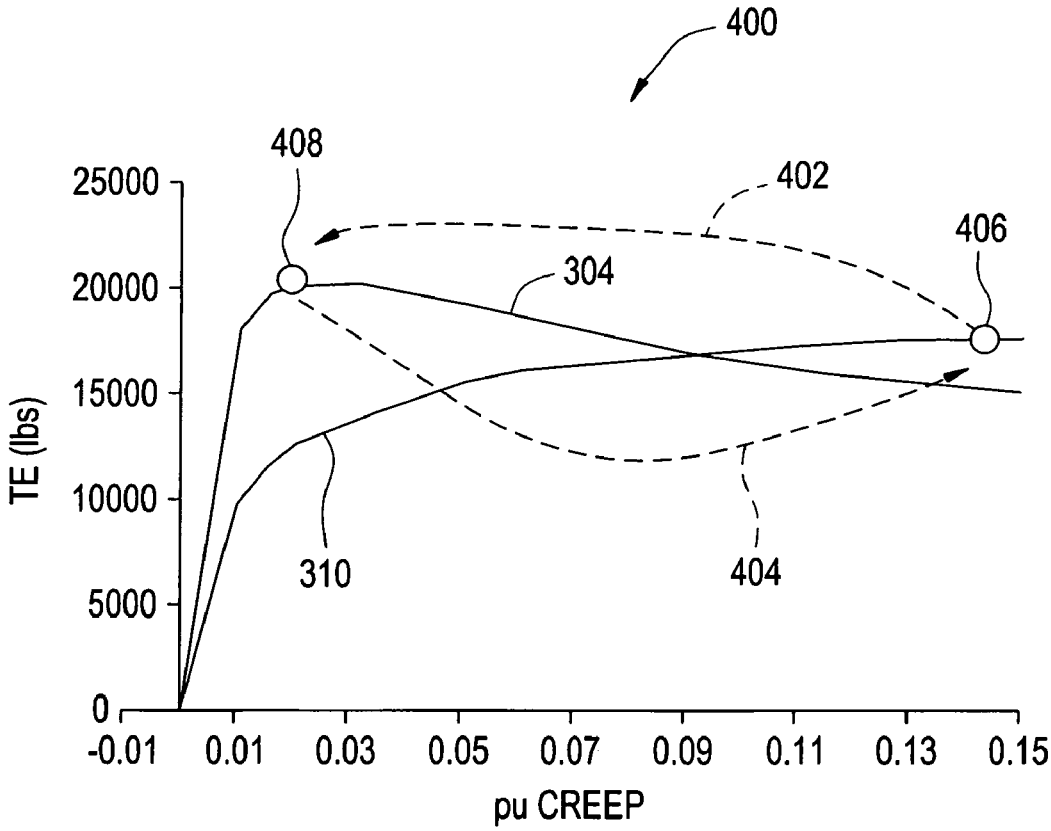
FIG. 4 illustrates exemplary friction/adhesion curves with and without sand applied in front of an axle during wet rail conditions.

Chart 400 in FIG. 4 illustrates two changes in the operating point of a wheel on a wet rail when sand is applied to the wet rail (curve 402) and when sand is removed from the rail (curve 404). For example, if sand is applied to a wet rail at point 406 on water curve 310, curve 402 illustrates that the creep decreases to point 408, a point on wet sand curve 304. Similarly, if operating at point 408 on the wet sand curve 304, the removal of sand moves the creep from point 408 to point 406 on curve 310, thereby indicating a significant increase in creep. FIG. 4 also illustrates optimal adhesion control system performance—creep is controlled such that maximum tractive effort is attained (assuming that the operator is calling for more tractive effort than what can be sustained by the rail conditions). Therefore, such a change can be observed by an adhesion control system only when the wheel utilizes the available adhesion at the wheel and it typically happens at high tractive effort, low speed operating conditions. At other operating conditions the tractive effort versus creep characteristics change but not as dramatically.

In this illustration, a locomotive is applying 17,000 pounds of tractive effort. However, at point 406 the rail is wet and the locomotive wheels are experiencing a per unit creep of more than 0.14. Sand is applied immediately prior to the advancing wheel of the locomotive. As a result, at point 408 tractive effort is increased to 20,000 pounds and per unit creep is reduced to less than 0.03. If the sand application is later removed, the operating point returns from point 408 to the prior operating point 406.

Figure 5:
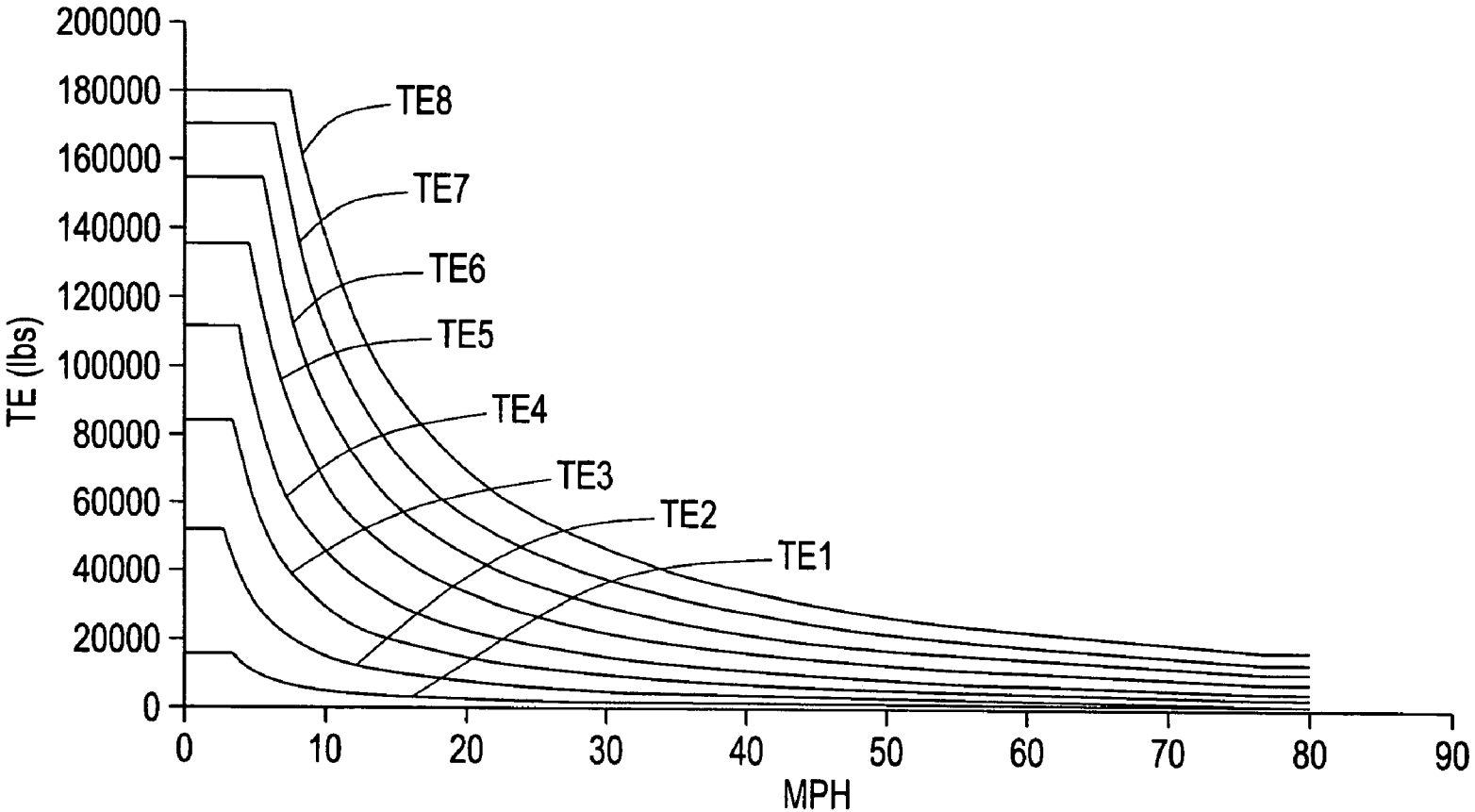
FIG. 5 is an exemplary graph illustrating the tractive effort in pounds in relation to the speed of the train for eight throttle settings.

FIG. 5 illustrates TE in pounds as a function of the speed of the train for eight tractive effort or throttle settings denoted TE1 to TE8. As shown, for a low speed there is a significant variation in the TE for each of the throttle settings. However, as speed increases, TE reduces and approaches a relatively close level as the speed exceeds 50 miles per hour. It should also be noted that for each throttle setting, TE remains constant until a break speed is reached, as denoted in FIG. 5. Above that brake speed power is held constant.

Figure 6:
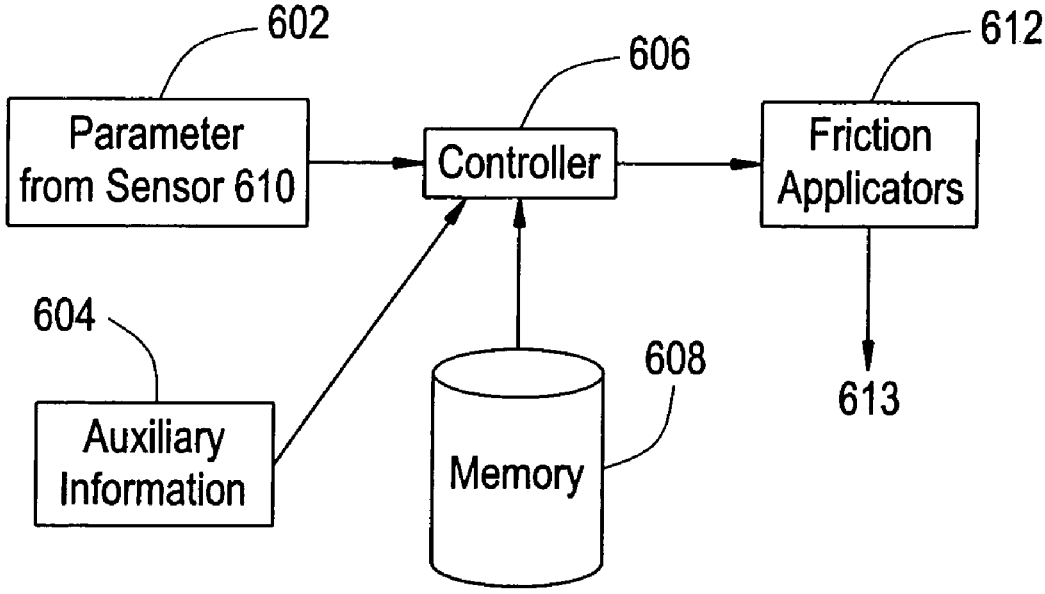
FIG. 6 is a schematic diagram of a sand limiting system according to the present invention.

Referring now to FIG. 6, an exemplary aspect of the invention may include a sensor 602 for monitoring one or more parameters 610 relating to the operation of one or more locomotives such as locomotive 122. Parameters 610 may be various operational parameters, which may be related to the interaction between the wheels of locomotive 122 and the railroad rails over which locomotive 122 is traversing.

Exemplary parameters 610 may include operational parameters associated with locomotive 122 such as speed, tractive effort (TE), throttle or notch setting, wheel speed, rate of acceleration or deceleration, braking condition, force, wheel slip/slide, fuel consumption, wheel creep, engine horsepower, traction motor torque and a sanding effectiveness. These may be based on a per axle, per truck, or per locomotive basis. In one aspect of the invention sanding effectiveness may be expresses in terms of tractive effort as described herein below.

Auxiliary information or data 604, as well as operational parameters 610, may be used in aspects of the invention as input for controlling or limiting the amount of sand applied to railroad rails by a train such as locomotive 122. Exemplary data 604 may include consist/train length, train weight, track map, geographical location of a train, track topography, track grade, track curvature, rail temperature, physical characteristics of a rail such as being dry, wet, greasy or oily, whether conditions such as rain, snow or ice, the presence of rail modifiers on rail, both the current and forecasted weather, train schedules or external commands from operators or dispatch centers.

As shown in FIG. 6, operational parameters 610 and/or auxiliary data 604 may be input into a controller 606, which may be configured with a memory or storage device 608. Controller 606 may control aspects of the invention for limiting the amount of sand applied to railroad rails and may be located on locomotive 122. One aspect allows for a flow of sand from sand boxes 204, 206 to be controlled based on controller's 606 response to one or more operational parameters 610 and/or auxiliary data 604. Controller 606 may control a flow of sand 613 through friction enhancing or sand applicator 612, which may schematically represent nozzles 102-108 and/or nozzles 110-116 positioned on locomotive 122 trucks 124, 126, respectively, shown in FIG. 2.

Exemplary embodiments allow for a locomotive or a railway car to be equipped with an applicator 612 that is responsive to controller 606. Applicator 612 applies a friction-modifying agent, such as sand 613 to the rail at an area of contact between one or more railway wheels and the rails on which they are traversing. Friction modifying agents 613 may be enhanced adhesion materials such as sand, or the removal of snow or water from the rail. Friction reducing agents may be water, steam, air, oil, a lubricant, or may be the removal of sand, water, snow or a friction-enhancing agent that exists on the rail at the time. In either case, cleaning the rail with a brush, or with water or air, may be friction enhancing or friction reducing depending on the existing state of the rail.

Controller 606 may be configured to analyze these and other operational parameters 602 and auxiliary data 604 to determine the appropriate timing and quantity of friction modifying agent 613 to be applied. For example, the amount of friction modifying agent 613 applied by applicator 612 may be optimized based on the length of the train and the weather conditions such that the modifying agent 613 is consumed or dissipated by the time the last car in a train configuration passes the point of application of modifying agent 613.

In an embodiment of the invention, a train configuration may have a plurality of applicators 612 located at positions that are before the wheels of locomotive 122 regardless of the direction of travel. As a locomotive may work in the forward or reverse directions, locomotive 122 may be configured with friction-modifying agent applicators 612 at both ends of the vehicle. Additionally, applicators 612 may be applied to the leading end or the trailing end of locomotive 122 or a railway car for application of a friction-modifying agent 613. For example, FIG. 1 illustrates that applicators 612, which may be nozzles 102-116 may be placed proximate the forward and rearward wheels of trucks 124, 126 to apply a friction-modifying agent ahead of these wheels relative to a direction of travel of locomotive 122.

Applicators 612 may be configured on locomotive 122 so friction modifying agent 613 is applied to defined points of application. As such, there may be a plurality of applicators 612 on one or more railway vehicles within a train consist. Applicators 612 may be configured to apply friction-modifying agent 613 to the wheel flange, the wheel rim, the top of the rail (TOR) and/or to the rail gage side (RAGS). Controller 606 determines the type, timing and quantity of the friction-modifying agent 613 to be applied. Controller 606 may select one or more applicators 612 from among a plurality of applicators 612 located on locomotive 122 and/or a railway car to apply agent 613 and the points of application on the rail to which it will be applied.

A plurality of applicators 612 may be positioned on one or more locomotives and/or railway cars to optimize friction management of a train consist. A train consist is typically comprised of a lead motoring locomotive, one or more optional secondary motoring locomotives, an optional trailing motoring locomotive positioned at a point distant from the lead and secondary motoring locomotives, and one or more railway cars. An applicator 612, and therefore the application of friction modifying agent 61, may be positioned as a lead applicator of the lead motoring locomotive, a trailing applicator of the lead motoring locomotive, a lead applicator of the secondary motoring locomotive, a trailing applicator of the secondary motoring locomotive, a lead applicator of the trailing motoring locomotive, a trailing applicator of the trailing motoring locomotive, a lead applicator of a railway car, or a trailing applicator of a railway car. Other combinations will be recognized by those skilled in the art.

Controller 606 may communicate by one or more communication systems or links (not shown) among the controller 606, locomotives and railway cars for controlling application of a friction-modifying agent such as sand, for example.

Figure 7:
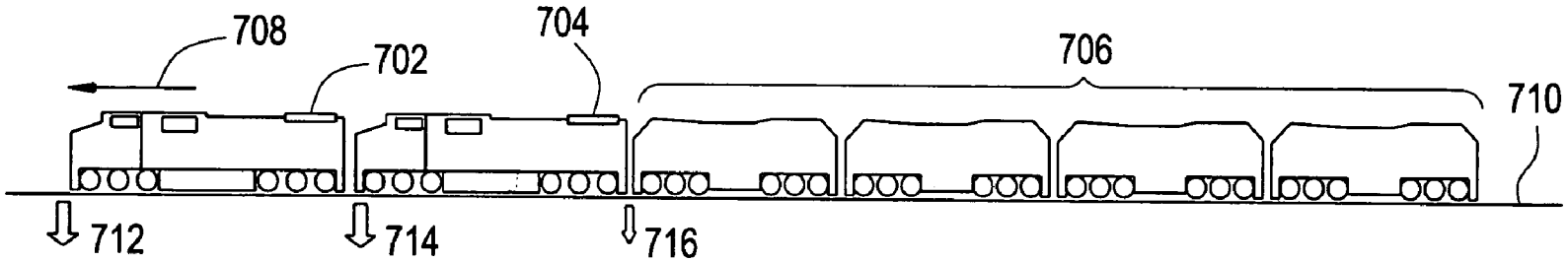
FIG. 7 is a first illustration of a configuration illustrating the location of application of friction-modifying agents in a first train configuration.

FIG. 7 shows an embodiment of a train configuration that may be equipped with an exemplary embodiment of the invention. In a first configuration, two locomotives, a lead motoring locomotive 702 and a secondary motoring locomotive 704, are connected to four railway cars 706 and are moving on railway track or rail 710 in the forward direction from right to left as indicated by arrow 708. In this case applicator 712 is an applicator that applies a friction-modifying agent 613 to rail 710 ahead of the forward wheels of the lead motoring locomotive 702. Applicator 712 may apply a friction-enhancing agent such as sand or may remove or neutralize an agent or material on rail 710. For example, if rail 710 is wet or covered with snow or ice, and controller 606 determines that friction enhancement is required, applicator 712 may apply compressed air to dry the top of rail 710, or may apply steam to melt the snow or ice. Additionally, if the lead motoring locomotive 702 is entering a curved section of track, applicator 712 may apply a lubricant such as water or oil to the rail gage side of the track to reduce friction of the wheel to rail 710.

Secondary locomotive 704 is configured with applicator 714 at the leading end of the locomotive 704. Controller 606 controls the application of friction-modifying agents 613 by applicator 714 based on the determined need. In some situations, controller 606 may determine that agent 613 applied by applicator 712 on the leading locomotive 702 is sufficient for both the lead 702 and secondary 704 locomotive. This may be the case when water, snow or ice is on the track and applicator 712 is controlled to remove the water, snow or ice. However, where a steep incline is encountered, controller 606 may control applicators 712 and 714 to apply a friction-enhancing agent 613 such as sand to the top of the rail.

Also as shown in FIG. 7, applicator 716 is configured at the trailing end of secondary motoring locomotive 704. Applicator 716 may be configured to remove or neutralize any friction-enhancing agents 613 applied by applicators 712 and/or 714. Furthermore, applicator 716 may apply a friction-reducing agent such as air, water, oil or a lubricant to the top of the rail 710 or to the rail gage side to reduce the friction between the rail 710 and the wheels of the trailing railway cars 706.

Figure 8:
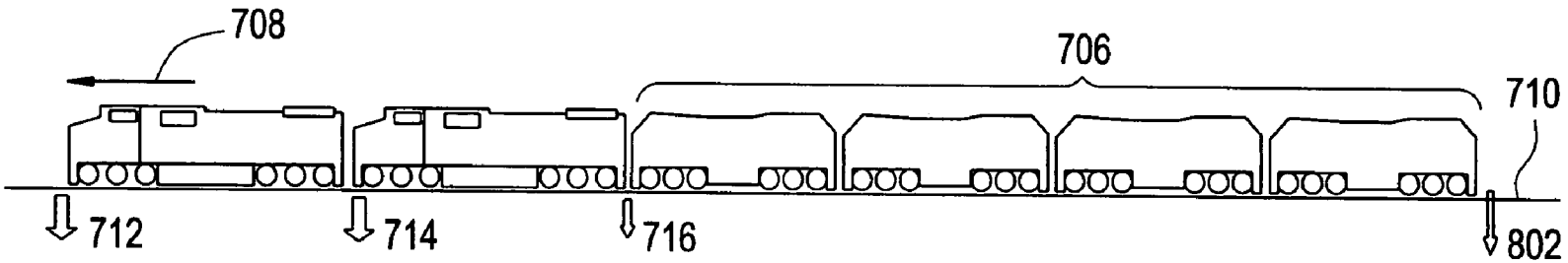
FIG. 8 is a second illustration of a configuration illustrating the location of application of friction-modifying agents in a second train configuration.

Referring now to FIG. 8, a second train configuration illustrates the addition of applicator 802 in another exemplary embodiment of the invention. Applicator 802 is located at the end of the train configuration that may be a railway car 706 as illustrated, or a locomotive. Applicator 802 may be at the front or the rear of car 706 and be configured to remove or neutralize any friction-modifying agents 613 applied earlier by applicators 712, 714 or 716. This may be desirable to clean rail 710 prior to the next train configuration using the same section of rail 710. However, controller 606 may determine, for example, that application of a rail cleaning agent may not be required due to current or forecasted weather, or the absence of another train using rail 710 within a predetermined period of time.

For instance, if a lubricant is applied by applicator 716, controller 606 may determine that applicator 802 need not apply a neutralizing agent if it is raining and another train is not scheduled to traverse the same rail 710 for an hour or more. Additionally, if controller 606 can determine the optimal amounts of friction-modifying agent 613 to be applied to rail 710 by applicator 716 based on parameters 610 and/or auxiliary data 604, such as the length of the train and the weather conditions, then modifying agent 613 may be consumed or dissipated by the time the last car in a train configuration passes. In such cases, there will not be a need to cleanse the track by applicator 802.

Figure 9:
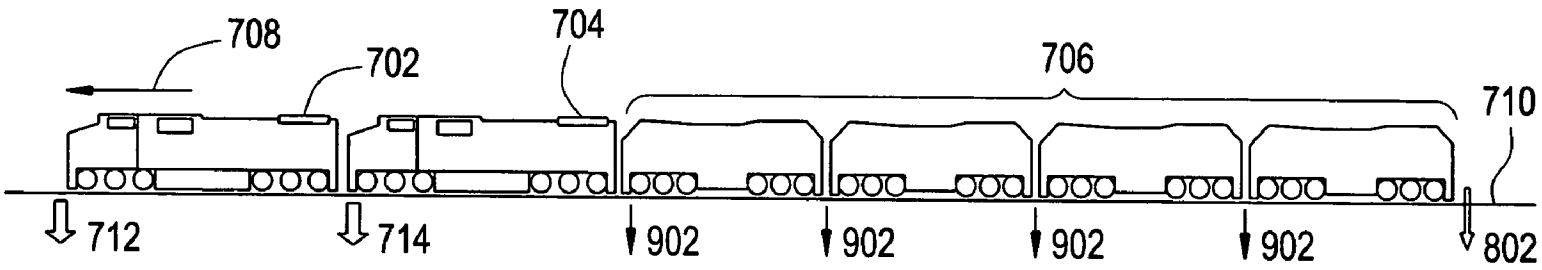
FIG. 9 is a third illustration of a configuration illustrating the location of application of friction-modifying agents in a third train configuration.

Now referring to FIG. 9, railway cars 706 may be configured with one or more applicators 612 to apply friction-modifying agents 613. Such applicators are indicated by 902 wherein any number of cars 706 may be in a train configuration and any number may be equipped with friction modifying applicators 902. While applicators 902 configured on railway cars 706 are often friction-reducers, they may be of any type. Such applicators 902 may be controlled by controller 606, typically the same system that manages applicators 712, 714, 716, and 802. Controller 606 may control application of friction-modifying agents 613 to rail 710, which may include application of friction-reducing agents either to the top of the rail 710 or to the rail gage side if the train is traversing a section of rail 710 with a curve. In such an instance, controller 606 may control application of a friction-reducing agent such as a lubricant on the inside of the rail. Under certain conditions, controller 606 may apply lubricant using applicators 610 on the inside rail of the curve and not apply any on the outside rail of the curve.

Figure 10:
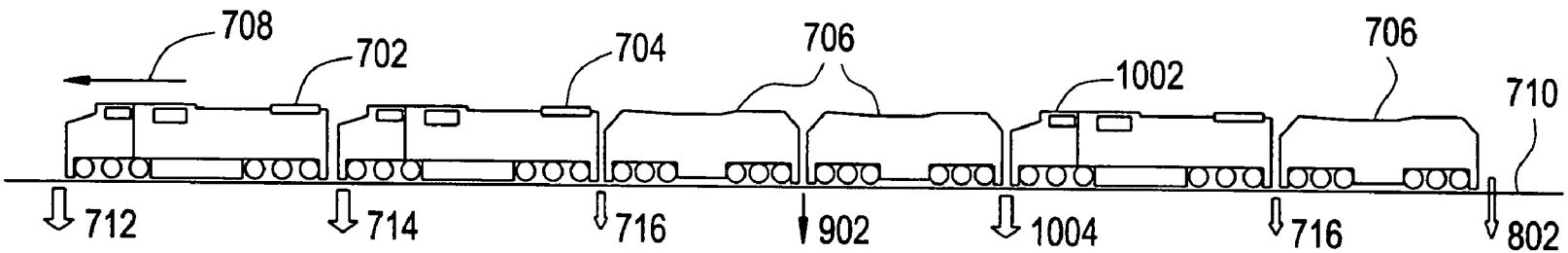
FIG. 10 is a fourth illustration of a configuration illustrating the location of application of friction-modifying agents in a fourth train configuration.

Referring to FIG. 10, a train configuration may have a locomotive 1002 positioned remote from the lead 702 or secondary 704 locomotives. Trailing locomotive 1002 may be positioned at the end of the train configuration (not shown) or in the middle of a train configuration (shown) such that railway cars 706 are positioned in front of and behind trailing locomotive 1002. In this embodiment of the invention, trailing locomotive 1002 may be equipped with an applicator 1004. Applicator 1004 may apply either a friction-enhancing or friction-reducing agent as instructed by controller 606. When controller 606 determines that a friction-enhancing agent will be required to improve the tractive effort of trailing locomotive 1002, applicator 1004 may be instructed to remove or neutralize the friction-reducing agent applied earlier by applicators 716 or 902, and apply a friction-enhancing agent 613 such as sand.

In other situations, applicator 1004 may be instructed to apply the neutralizing agent to dry the rail that increases the coefficient of friction or may be instructed to apply sand if necessary for a particular section of rail 710 or track grade. Trailing locomotive 1002 may be configured with an applicator 716 as discussed earlier. Additionally, railway cars 706 trailing from the trailing locomotive 1002 may be equipped with applicator 802 to cleanse the rail 710 after the train has passed.

Figure 11:
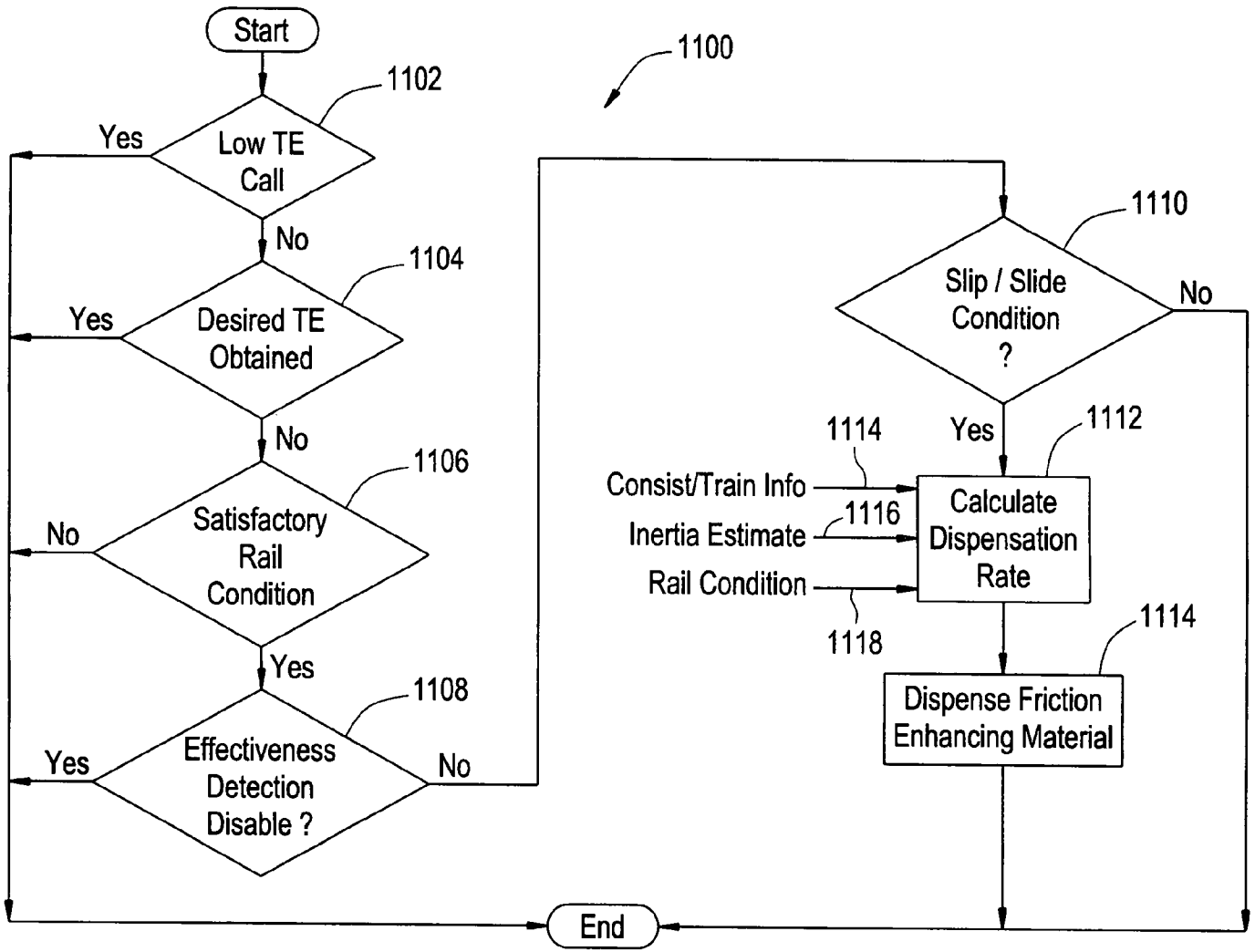
FIG. 11 is an exemplary flow chart for managing and controlling the application of a friction-enhancing agent to the rails according to one embodiment of the invention.

Controller 606 may receive operating parameters 610 from one or more sensors 602 on the train, or associated with the train. Additionally, controller 606 may receive auxiliary data 604 from other sources that affect the management and optimization of the friction between the railway wheels and the rail. FIG. 11 is an embodiment of a decision chart 1100 according to an exemplary embodiment of the invention. In FIG. 11, step 1002 illustrates that the train configuration is operating at a low speed and a low tractive effort has not been called. In such a case, desired tractive effort, actual tractive effort, rail condition, and slip/slide condition are determined. If the desired tractive effort in 1104 is not obtained or obtainable under the present of planned situation or condition, there is satisfactory rail conditions for the desired tractive effort 1106, the effectiveness detection has not been disabled 1108, and a slip or slide condition is not present 1110, then controller 606 obtains consist or train data 1114 related to the weight of the consist, the train configuration length, an inertia estimate of the train 1116 and the rail condition 1118. Controller 606 then determines whether friction-modifying agents 613 should be applied to the rail, where to apply the agents 613, which applicators 612 to activate for applying the agents 613, which agents 613 should be applied and the quantity or dispensation rate 1112 of agents 613 to be applied.

In an exemplary embodiment, controller 606 instructs at 1114 one or more applicators 612 to apply the desired agents 613. In this case, FIG. 11 illustrates that friction-enhancing agents 613 should be dispensed due to the need to increase the actual tractive effort to match the desired tractive effort. Once the desired tractive effort is obtained in 1104, the process ends. Additionally, if any of the other conditions are not met such as a low tractive effort call 1102, unsatisfactory rail condition 1106, the effectiveness detection system is disabled 1108, or a slip or slide condition is detected 1110, then the process also ends.

As noted in FIG. 11, controller 606 may determine that the conditions are such that friction-enhancing agents 613 should not be applied. For instance, controller 606 may find that the train is equipped with sand as a friction enhancer. However, controller 606 may obtain the rail conditions that indicate that the rail 710 is wet due to rain or snow. As such, controller 606 decides that the application of sand to a wet rail may actually reduce the tractive effort rather than increase it as shown in FIG. 4. As such, sand would not be applied. However, controller 606 may decide that while sand will not provide sufficient enhanced traction, that since the locomotive is equipped with an applicator for applying compressed air to the track, that air should be applied to the rail to dry the rail 710, thereby providing an improved friction.

Figure 12:
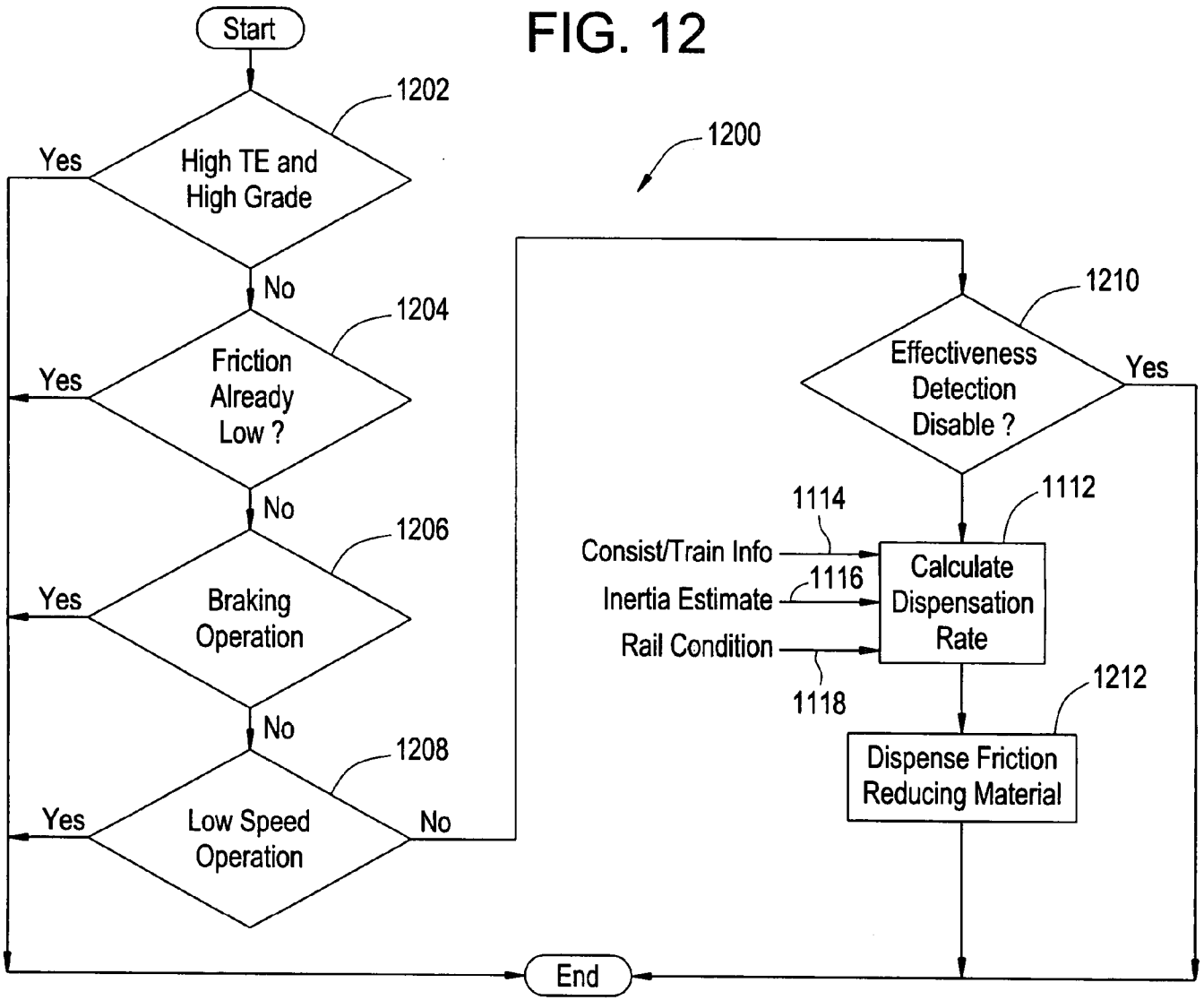
FIG. 12 is an exemplary flow chart for managing and controlling the application of friction-reducing agent to the rails according to one embodiment of the invention.

FIG. 12 illustrates another decision flow chart 1200 for the controller 606 in another exemplary embodiment of the invention. In this embodiment, in 1202 the tractive effort is high and a high grade does not currently exist or is not located in the track to be traversed by the train. Controller 606 receives an additional parameter that indicates that the friction is too high 1204 and that a braking operation does not exist in 1206. If the train is operating at a speed that is not too low, a braking operation is not current 1206, and the effectiveness detection is not disabled 1208, controller 606 receives additional auxiliary data 604 as to the train weight, length and configuration 1114, an estimate of the inertia of the train 1116, and the condition 1118 of rail 710.

From this data, controller 606 determines the type, quantity, dispensation rate, and location 1112 for applying a friction reducing material 1212. As with the prior example, controller 606, by receiving input with respect to one or more parameters 610 and/or auxiliary data 604, may determine that a friction-reducing agent should not be applied. For example, if the tractive effort is high or there is a high grade 1202, if the friction is already low 1204, if there is a braking operation 1206, if there is a low speed operation 1208, or if the effectiveness detection has been disabled, then the controller 606 may end the process.

In another exemplary embodiment, data related to the length/weight/power of a train consist may be used to determine the timing and the quantity of a friction-modifying agent 613 to be applied to the rails. A track map based on a CAD system and a GPS location may be used by controller 606 to determine when, how much and what type of agent 613 is to be applied. Furthermore, computer aided dispatch systems that gather and analyze train parameter information including the length of the train, weight of the train, the speed of the train and the applied power may be used as an input of auxiliary data 604 to determine when and how much friction modifying agent 613 to apply. A train scheduler/movement planner system and/or RR dispatcher to determine train characteristics are also contemplated as input to the controller 606's decision making process.

Another parameter 610 that may be utilized by controller 606 is an inertia estimate that may be based on tractive effort, track grade, locomotive speed and/or position. The inertia of a train may be determined by the acceleration change per tractive effort change assuming the track grade has not changed. The track grade may be compensated for if known. The acceleration may be obtained from sensor 602 on board a locomotive. The tractive effort is the estimate of force, which can be obtained typically from current and voltage measurements on the traction motors (not shown) or it could be obtained from other direct sensors such as sensor 602. The track grade could be obtained from inclinometers or could be assumed to be the same if the measurements are done over a short period of time. Another technique could use the position of the train, possibly as determined by an on-board GPS receiver to obtain speed and/or track grade. Another technique could use the track map information based on GPS, operator inputs or side transponders.

Other parameters 610 that may be utilized by controller 606 are speed, throttle setting, and/or tractive effort. The dispensation of both high adhesion material and low adhesion material may be optimized based on operation of the locomotive. For example, when the consist or train operator calls for high tractive effort (high notch/low speed) then an embodiment allows for only applicators 712, 714 and 1004 to be enabled. If the tractive effort produced is what the operator has requested, then there is no need to add friction-increasing materials. Most of the fuel efficiency benefits are at high speeds (when tractive effort is low). Under these conditions, applicators 716 and 902 may be enabled and optionally applicator 802 may be enabled.

The condition of rail 710 is another parameter 610 or item of auxiliary data 604 that may be used to determine optimal friction management. In order to optimize the cost, the dispensing of friction modifying agents 612 can be controlled based on the rail conditions. For example, if rail 710 is dry and clean, then there may be no need to dispense high adhesion material. Similarly, when there is rain/snow, it may not be necessary to dispense friction-lowering material since the reduction in friction may not be appreciable. Another example is if it is raining or rain is expected before the next train, then there may not be a need to remove low friction material from the rails. These rail conditions could be inferred based on sensors 602 already on board based on adhesion/creep curves, or could be based on additional sensors 602, or inputs from a dispatch center, operators, external transponders, weather satellites, etc.

For rail cars 706 and or idle wheels, creep could be used to estimate the friction coefficient. A separate sensor 602 could be used to determine the coefficient of friction. These sensors 602 could be placed at every point where friction lowering material dispensing is applied or at the end of the locomotive consist. Similarly, friction sensors 602, or creep of the last wheel(s), may be used for dispensing neutralizing friction-modifying material from applicator 802 in the exemplary embodiment of FIG. 8.

During distributed power operation, the dispensing of adhesion lowering material in the lead consist may depend on the number/weight of load cars between the lead consist and the trail consist (information of cars between applicators 716 and 1004 in FIG. 10). This information could be obtained using the distance information between the locomotives 704 and 1002. This could be obtained from GPS position information or even using techniques like the time for brake pressure travel information. The dispensing at applicator 716 could be adjusted also based on the friction seen by the trailing locomotive 1002. For example, if the trailing locomotive 1002 encounters very low friction, then too much material may be being dispensed by nozzle 716.

Referring to FIGS. 1 and 6, embodiments of the invention may be configured to limit the amount of friction-enhancing material, such as sand, applied to railroad rails in response to monitored operational parameters 610 and/or auxiliary information 604. Appropriate sensors such as sensor 602 may monitor operational parameters 610 and/or auxiliary information 604. Data indicative of a respective value of parameters 610 and information 604 may be transmitted to controller 606, which may be part of locomotive control system 220. It will be appreciated that embodiments of the invention may be computer controlled methods and systems with controller 606 and control system 220 being examples of computer controllers that may be part of or used to implement embodiments of the invention.

Appropriate aspects of the invention may be provided on computer readable mediums known in the art that may be executed by controller 606 and/or control system 220. Exemplary embodiments of the invention may use controller 606 and control system 220 singly or in combination depending on a train consist's configuration and other design specifications. For example, locomotive control system 220 may be contained on a lead locomotive 122 with a plurality of controllers 606 deployed on respective locomotives dispersed in a consist. Data may be transmitted among control system 220 and controllers 606 using known telecommunications methods and hardware. Other configurations will be recognized by those skilled in the art.

Returning to FIGS. 1 and 2, an exemplary embodiment provides a plurality of sets of sand applicators where each set of applicators includes a pair of applicators. A pair of applicators may include a first sand applicator and a second sand applicator where one of the applicators applies sand to one of the railroad rails and the other applicator applies sand to the other of the railroad rails. For example, sand applicators or nozzles 102, 104 may be a first pair of sand applicators that apply sand ahead of first truck 124 with respect to the direction of travel of locomotive 122, i.e., when locomotive 122 is moving in a forward direction nozzles 102, 104 may apply sand ahead of the forward wheels of first truck 124. Similarly, sand applicators or nozzles 106, 108 may be a second pair of sand applicators that apply sand ahead of the rearward wheels of first truck 124 when locomotive 122 is moving in a rearward direction. It will be appreciated that the pair of nozzles 110, 112 and pair 114, 116 may apply sand with respect to second truck 126 in a similar manner.

An aspect of the invention allows for automatically controlling a flow of sand applied to one or both of the rails by sanding system 200 shown in FIG. 2. The flow of sand may be automatically controlled to limit the application of sand to those situations in which applying sand would be effective to increase the adhesion of locomotive 122 wheels on the railroad rails. Locomotive control system 220 may be programmed to determine when the application of sand would be effective to increase the adhesion of the wheels on the rails based on an analysis of operational parameters 610 and/or auxiliary information 604. If a determination is made that applying sand would be effective to increase adhesion then the flow of sand may be independently controlled to flow through one or more of the plurality of sand applicators in any combination.

In this respect, control system 220 may programmed to independently control air reservoir 202, air valves 208, 210, and sand valves 212-214 so that the flow of sand passes through respective nozzles 102-116 (each nozzle may be referred to as a point of sanding) either simultaneously, individually or in any combination thereof. For example, if locomotive 122 is moving forward it may be desirable to dispense the flow of sand through nozzle pair 102, 104 and pair 110, 112 simultaneously to achieve a desired increase in sanding effectiveness. In other situations it may be desirable to alternate the flow of sand between these nozzle pairs or direct the flow of sand through one pair only. It will be appreciated that the specific combination of individual nozzles or nozzle pairs dispensing sand onto one or both railroad rails may be a function of achieving a desired increase in sanding effectiveness. Independently controlling the flow of sand through nozzles 102-116 helps to limit the amount of sand applied to the rails. This may reduce the risk of environmental damage and the malfunctioning of railroad hardware such as yard or crossing switches. It is known that applying too much sand to such railroad hardware may cause damage to that hardware.

Operational parameters 610, such as throttle speed or notch, tractive effort (TE), locomotive speed, and locomotive acceleration and deceleration may be monitored and used as conditions for applying sand to the rails. In this aspect, monitored operational parameters 610, as well as auxiliary information 604, may be used to predict a potential increase in adhesion for applying sand to the rails or they may be used as conditions for initiating the application of sand, increasing or decreasing a flow of sand or not applying sand to the rails.

In one aspect, if control system 220 or operator of locomotive 122 is calling for full power (Notch8 or TE8) and other conditions are met then a flow of sand may be automatically applied to the rails. For example, if full power is called, locomotive 122 is not producing full power and one or more wheels of trucks 124, 126 are slipping then sand may be automatically applied forward of one or more trucks 124, 126 when locomotive 122 is moving in a forward direction. Sand may be applied using any combination of sand applicators 102, 104 and sand applicators 110, 112. Calling for full power may be a predictor, provided other conditions are met, that an increase in adhesion may be obtained if sand is applied to the rails. When locomotive 122 reaches a predetermined speed then the flow of sand may be stopped regardless of other operational parameter 610 values or those parameter values may indicate that sanding should continue at a constant or adjusted flow rate using the same or other sand applicators.

Tractive effort is typically measured in pounds as indicated in FIG. 5. Control system 220 may be programmed to automatically control a flow of sand if the tractive effort of locomotive 122 is below a threshold value regardless of the value of other operational parameters 610 and/or the state of auxiliary information 604. By way of example, if locomotive 122 is not achieving a tractive effort of 120 k pounds then control system 220 may automatically control the flow of sand through one or more sand applicators such as nozzle pairs 102, 104 and 110, 112 when locomotive 122 is moving in a forward direction. The threshold value of tractive effort may be a preselected value entered by an operator into a programming module of control system 220 or it may be a variable value called from memory 608. The variable threshold value may be called from a lookup table and be a function of various operational parameters 610 and/or auxiliary information 604.

Another exemplary embodiment allows for automatically controlling a flow of sand through one or more nozzles 102-116 in response to locomotive 122 traveling below a threshold speed or when locomotive 122 is decelerating regardless of the value of other operational parameters 610 and/or the state of auxiliary information 604. As with tractive effort, the threshold speed value may be a preselected value entered by an operator into a programming module of control system 220 or it may be a variable value called from memory 608. The variable threshold value may be called from a lookup table and be a function of various operational parameters 610 and/or auxiliary information 604.

Another exemplary embodiment allows for automatically controlling a flow of sand through one or more nozzles 102-116 in response to a sanding effectiveness measured after a quantity of sand has been applied to the railroad rails. In this aspect, the sanding effectiveness may be expressed in terms of an increase in tractive effort after applying the sand. For example, if locomotive 122 is traversing a set of railroad rails producing 120 k pounds of tractive effort ($TE_1$) then automatic sanding may be controlled to dispense a flow of sand onto the rails through nozzle pairs 102, 104 and 110, 112. After an interval of time has elapsed from beginning the sanding the tractive effort may be measured by control system 220 using know techniques. If the measured tractive effort is 180 k pounds ($TE_2$) then the sanding effectiveness in terms of tractive effort ($TE_{SE}$) is equal to 60 k pounds. Control system 220 may be programmed to continue the flow of sand at a constant rate provided the sanding effectiveness exceeds a threshold value, e.g., 60 k pounds. If the measured sanding effectiveness falls below 60 k pounds then control system 220 may reduce or stop the flow of sand, or dispense sand through other sand applicators. Directing the flow through fewer nozzles 102-116 or points of sanding may reduce the flow of sand.

By way of further example referring to FIGS. 1 and 2, control system 220 may be programmed to automatically control a flow of sand through a first pair of nozzles or sand applicators 102, 104 and a second pair of nozzles or sand applicators 110, 112 so that sand is applied on the rails ahead of the forward wheels of respective trucks 124, 126 when locomotive 122 is moving in a forward direction and producing 120 k of tractive effort but a higher tractive effort is called. Thus, there are four points of sanding, i.e., sand is flowing onto the rails from four nozzles 102, 104 and 110, 112. Control system 220 may be programmed to measure the tractive effort continuously or at predetermined intervals, for example, after the flow of sand has been initiated and then calculate the sanding effectiveness ($TE_2 - TE_1 = TE_{SE}$). The calculated $TE_{SE}$ may be used as a condition for continuing to apply sand using four points of sanding or reducing the flow of sand from four points to two points, for example. For instance, if the calculated $TE_{SE}$ equals 10 k pounds, and the threshold value of $TE_{SE}$ is 30 k pounds to continue sanding at the same rate, then control system 220 may be programmed to reduce the number of points of sanding from four points to two points, i.e., discontinue dispensing sand through nozzles 110, 112 but continue sanding through nozzles 102, 104.

It will be appreciated that the exemplary operational parameters 610 of throttle speed, tractive effort, locomotive speed, locomotive deceleration and sanding effectiveness may be used individually, collectively or in any combination as conditions for determining whether to apply compressed air to the railroad rails, when to apply sand to the rails, the number of points of sanding, the flow rate of sand and duration of sanding, for example. It will also be appreciated that threshold values for each operational parameter 610 may be established based on a variety of factors such as the number of locomotives in a consist, total number of cars in a consist, weather conditions and as well as other factors described herein that will be recognized by those skilled in the art.

Exemplary embodiments of the invention may use one or more pieces of auxiliary information 604, such as the geographical location of locomotive 122, as a condition for limiting the amount of sand applied to railroad rails. For example, it may be advantageous to apply sand or not apply sand to the rails when locomotive 122 is in certain geographical locations regardless of the value of operational parameters 610 and/or the state of auxiliary information 604. Such geographical locations may include locomotive 122 entering or being within a maintenance yard, passing mechanical or electrical rail switches at crossings, passing wayside greasers, traversing mountain passes or traveling through environmentally sensitive locations.

Control system 220 may be programmed or activated to permit or not permit sand to be applied to the rails depending on the geographical location of locomotive 122. For example, control system 220 may permit automatic sanding in certain geographical areas, such as going up a hill where no railroad hardware is located along the tracks. When locomotive 122 is in such an area then automatic sanding is permitted and may begin provided other conditions are met. Exemplary conditions, among others, may be full power being called when locomotive 122 is not producing full power and one or more wheels of trucks 124, 126 are slipping, or locomotive 122 has not reached a predetermined speed.

Similarly, control system 220 may be programmed or activated to not permit sanding in certain geographical areas, such as locomotive 122 passing by railroad hardware located along a section of track, or being within a maintenance yard. In this aspect, no sanding will be permitted regardless of the conditions of operational parameters 610 and/or other auxiliary information 604. Control system 220 may be programmed with data indicative of those geographical areas where sanding may be permitted or not permitted, or an operator may control system 220 in response to the location of locomotive 122. Data indicative of such geographical areas may be transmitted to control system 220 via GPS, transmitters positioned along a set of railroad tracks over which locomotive 122 is traversing or other means recognized by those skilled in the art.

An exemplary embodiment of the invention allows for determining or measuring wheel slippage of locomotive 122 and using wheel slippage as a condition for controlling the application of sand to the railroad rails to increase or enhance adhesion of locomotive 122 on the rails. In one aspect, a first quantity of wheel slippage of locomotive 122 may be determined when locomotive 122 is traversing a set of railroad rails. The first quantity of wheel slippage may be any detectable quantity or it may be a threshold quantity value. Wheel slippage is proportionally related to tractive effort. The higher the tractive effort the less wheel slippage will be detectable.

If the first quantity of wheel slippage is detected or exceeds a threshold value then control system 220 may be programmed to apply a flow of compressed air toward the railroad rails to clean their respective surfaces to increase adhesion between the wheels and the rails. The flow of compressed air may be applied to clean the rails ahead of the forward or lead wheels of one or both trucks 124, 126 of locomotive 122. Air reservoir 202 (FIG. 2) may supply the compressed air, which may be directed onto the rails using conventional hardware known in the art. Such hardware may be configured to direct the compressed air toward the rails from locations on trucks 124, 126 that are proximate respective nozzles 102-116. Other locations on locomotive 122 may be used provided the compressed air cleans the rails ahead of the wheels on respective trucks 124, 126 with respect to a direction of travel of locomotive 122.

Under certain operating conditions, applying a flow of compressed air to the rails may eliminate wheel slippage while locomotive 122 is traversing the rails. Another aspect allows for determining a second quantity of wheel slippage of locomotive 122. The second quantity of wheel slippage may be determined after a time interval has elapsed from when the flow of compressed air was initiated. The flow of compressed air may be continuous or intermittent. If a second quantity of wheel slippage is detected or exceeds a second threshold value control system 220 may be programmed to automatically control a flow of sand applied to one or both of the railroad rails.

The flow of sand may be applied through one or more nozzles 102-116 selected by control system 220. Control system 220 may be programmed to select a combination of nozzles 102-116 based on one or more operational parameters 610 and/or auxiliary information 604, for example. In an exemplary embodiment, when the second quantity of wheel slippage exceeds a second threshold value control system 220 may apply two points of sanding ahead of the forward wheels of truck 124 using a first set of sand applicators 102, 104 when locomotive 122 is moving in a forward direction.

Another aspect allows for determining a third quantity of wheel slippage of locomotive 122. The third quantity of wheel slippage may be determined after a time interval has elapsed from when the flow of sand was initiated. If a third quantity of wheel slippage is detected or exceeds a third threshold value control system 220 may be programmed to automatically control a flow of sand applied to one or both of the railroad rails.

The flow of sand may be applied through one or more nozzles 102-116 selected by control system 220. Control system 220 may be programmed to select a combination of nozzles 102-116 based on one or more operational parameters 610 and/or auxiliary information 604, for example. In an exemplary embodiment, when the third quantity of wheel slippage exceeds a third threshold value control system 220 may increase the flow of sand from two points of sanding to four points of sanding so that sand is applied in front of each of the forward wheels of each of respective trucks 124, 126. Thus, a first set of sand applicators 102, 104 and a second set of sand applicators 110, 112 will apply sand to the rails ahead of the forward wheels of trucks 124, 126 with locomotive 122 moving in a forward direction.

Another aspect allows for measuring the sanding effectiveness after a flow of sand has been applied to the rails in response to the detection of wheel slippage. Control system 220 may be programmed to measure the tractive effort continuously or at predetermined intervals, for example, after the flow of sand has been initiated and then calculate the sanding effectiveness ($TE_2 \cdot - TE_1 = TE_{SE}$). If a desired sanding effectiveness is not achieved then control system 220 may automatically vary the flow rate of sand by reducing the number of points of sanding, i.e., changing from four points of sanding (nozzles 102, 104 and 110, 112) to two points of sanding (nozzles 102, 104), or from two points of sanding (nozzles 102, 104) to no sanding.

Similarly, if wheel slippage is detected when compressed air is being applied to the railroad rails then control system 220 may automatically begin sanding through two points of sanding (nozzles 102, 104). If a desired sanding effectiveness is not achieved then control system 220 may discontinue sanding but continue to apply compressed air to the rails.

Another aspect of the invention allows for using monitored operational parameters 610 and/or auxiliary information 604 as a condition for applying sand to the rails or not applying sand in addition to detecting wheel slippage. If a quantity of wheel slippage is detected then control system 220 may determine whether one or more operational parameters 610 exceeds or is below a threshold value. If so, then control system 220 may automatically control a flow of sand through selected points of sanding in response to the detected wheel slippage and monitored operational parameter 610.

Similarly, if wheel slippage is detected and auxiliary information 604 satisfies predetermined criteria then control system 220 may automatically control the flow of sand. For example, if wheel slippage is detected and locomotive 122 is going up a grade then control system 220 may automatically begin a flow of sand using four points of sanding (nozzles 102, 104 and 110, 112). Sanding effectiveness may then be measured and control system 220 may adjust the flow rate of sand or number of points of sanding, for example, in response to the measured sanding effectiveness. Other exemplary auxiliary information 604 may include the physical characteristics of the railroad rails such as being dry, wet or oily.

Another exemplary method may include the situation where if locomotive 122 is operating at a low speed, such as below 10 mph, full tractive effort is called for by the locomotive 122 operator or control system 220, and at least one wheel on one or both trucks 124, 126 is slipping then compressed air may be applied to the rail ahead of the at least one slipping wheel. If the at least one wheel is still slipping after applying compressed air then control system 220 may measure the tractive effort being produced by locomotive 122 to determine if it is below a threshold value, such as 120 k lbs., for example. If the tractive effort is below the threshold value and locomotive 122 is decelerating then control system 220 may independently control sand applicators 102-116 to apply sand to at least one rail ahead of the at least one slipping wheel. For example, two points of sanding may be applied ahead of wheels on truck 124 using sanding applicators 102, 104.

Further, while sand is being applied to the at least one rail control system 220 may determine whether a threshold value of sanding effectiveness is being achieved ($TE_2 \cdot - TE_1 = TE_{SE}$). If a desired sanding effectiveness is being achieved then control system 220 may continue the two points of sanding (sand applicators 102, 104) and if it is not being achieved then control system 220 may discontinue sanding. If the desired sanding effectiveness is being achieved then control system 220 may measure the tractive effort being produced by locomotive 122 to determine if it is below a threshold value, such as 140 k lbs., for example. If the tractive effort is below the threshold value and locomotive 122 is still decelerating then control system 220 may independently control sand applicators 102-116 to apply sand to additional points on the at least one rail. For example, control system 220 may now apply sand using four points of sanding ahead of wheels on truck 124, 126 using sanding applicators 102, 104 and 110, 112.

Exemplary embodiments of the invention provide for control system 220 to be programmed to control the flow rate of sand flowing through one or more nozzles 102-116. In one aspect, control system 220 may control metering valves 205, 207 that cooperate with respective sand boxes 204, 206 shown in FIG. 2. Metering valves 205, 207 may be of a conventional type and may include, for example, electronically controlled valves that vary an aperture size in sand boxes 204, 206 for regulating the flow of sand from these boxes toward sand valves 212-218. Control system 220 may be programmed to control valves 205, 207 so that sand flows from boxes 204, 206 continuously or at timed intervals. Another aspect allows for control system 220 to control the flow rate of sand by regulating an amount of compressed air flowing from air reservoir 202. A continuous or pulsed flow of compressed air may be used to control the flow of sand through respective nozzles 102-116.

Aspects of the invention allow for upgrading or retrofitting legacy locomotives to improve the locomotive's tractive effort rating and be equipped with hardware and software for implementing aspects of the invention. Improving the tractive effort rating of locomotives in service is beneficial because with improved tractive effort the locomotive's sanding system may limit the amount of sand applied to rails if that system's decision making criteria for sanding is based at least in part on tractive effort.

A locomotive's tractive effort rating may be increased or improved by replacing a traction motor of the locomotive or installing a software module for controlling operational parameters of the locomotive affecting the tractive effort rating of the locomotive. A legacy locomotive may have its tractive effort rating increased in this manner and be equipped with hardware and software enabling that locomotive to implement embodiments of the invention.

The technical effect of embodiments of the invention is to control a locomotive's sanding system so that the amount of sand applied to railroad rails is limited to those situations where applying sand would be effective to increase the adhesion between the locomotive wheels and the railroad rails by a predetermined incremental amount.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

I claim:

1. A method of limiting sand use in a railroad locomotive sanding system applying sand to railroad rails to enhance adhesion of wheels of a railroad locomotive on a track having a pair of railroad rails, the sanding system comprising a plurality of sand applicators for each rail for directing sand flow toward the rail and with the locomotive having two trucks carrying the wheels for supporting and propelling the locomotive along the track, the method comprising:

automatically controlling a flow of sand applied to the rail by the locomotive sanding system to limit the application of sand to situations in which applying sand to the rail would be effective to increase the adhesion of at least one of the railroad locomotive wheels on the rail by a predetermined incremental amount; and independently controlling the operation of each of the plurality of sand applicators for selectively operating those sand applicators whose operation will result in at least the predetermined incremental increase in adhesion of the locomotive wheels on the rail, while not operating the other sand applicators so as to limit the amount of sand applied to the track.

2. The method of claim 1 further comprising:

monitoring an operational parameter associated with the locomotive where the monitored operational parameter is used as a condition for controlling the operation of the sand applicators.

3. The method of claim 2 further comprising: measuring a sanding effectiveness after a quantity of sand has been applied; and automatically controlling the flow of sand based on the measured sanding effectiveness.

4. The method of claim 2 further comprising:

selecting the sand applicators to be operated based on the monitored operational parameter.

5. The method of claim 2 wherein the monitored operational parameter is selected from the group of operational parameters comprising throttle setting, tractive effort. speed and deceleration.

6. The method of claim 1 wherein automatically controlling the flow of sand further comprising applying compressed air to each rail to clean each rail ahead of the at least one wheel of the locomotive.

7. The method of claim 1 wherein automatically controlling the flow of sand further comprising measuring a sanding effectiveness of applying sand to each rail at a time interval after sand has been applied to each rail;

monitoring an operational parameter associated with the locomotive; and automatically controlling the flow of sand based on at least one of the measured sanding effectiveness and the monitored operational parameter.

8. A method of limiting sand use in a railroad locomotive sanding system applying sand to railroad rails to enhance adhesion of wheels of a railroad locomotive on the rails, the sanding system comprising a plurality of sand applicators for directing sand flow toward the rails, the method comprising:

determining a first quantity of wheel slippage of the locomotive;

applying a flow of compressed air toward the rails if the first quantity of wheel slippage exceeds a first threshold value, the flow of compressed air applied to clean the rails ahead of lead wheels of the locomotive with respect to a direction of travel of the locomotive;

determining a second quantity of wheel slippage of the locomotive; and automatically controlling a flow of sand applied to at least one of the rails by the locomotive sanding system if the second quantity of wheel slippage exceeds a second threshold value.

9. The method of claim 8 further comprising:

independently controlling the plurality of sand applicators so the flow of sand is applied to at least one of the rails ahead of at least one wheel of a first pair of lead wheels carried on a first truck of the locomotive with respect to a direction of travel of the locomotive.

10. The method of claim 9 further comprising:

monitoring an operational parameter associated with the locomotive; and automatically controlling the flow of sand applied to the at least one of the rails if the second quantity of wheel slippage exceeds the second threshold value and a value of the monitored operational parameter is within a predetermined value range.

11. The method of claim 10 wherein the monitored operational parameter is selected from the group of operational parameters comprising throttle setting, tractive effort, speed, deceleration and sanding effectiveness.

12. The method of claim 10 further comprising:

measuring a sanding effectiveness at predetermined time intervals after applying sand to the rails; and automatically controlling the flow of sand through at least one of the plurality of sand applicators based on the measured sanding effectiveness.

13. The method of claim 8 further comprising:

determining a third quantity of wheel slippage of the locomotive;

if the third quantity of wheel slippage exceeds a third threshold value, independently controlling the plurality of sand applicators so the flow of sand is applied to at least one of the rails ahead of at least one wheel of a first pair of lead wheels carried on a firs: truck of the locomotive and at least one wheel of a second pair of lead wheels carried on a second truck of the locomotive with respect to a direction of travel of the locomotive.

14. The method of claim 13 further comprising:

measuring a sanding effectiveness at predetermined time intervals after applying sand to the rails; and automatically controlling the flow of sand through at least one of the plurality of sand applicators based on the measured sanding effectiveness.

15. The method of claim 13 further comprising:

monitoring an operational parameter associated with the locomotive; and automatically controlling the flow of sand applied to at least one of the rails if the third quantity of wheel slippage exceeds the third threshold value and a value of the monitored operational parameter is within a predetermined value range.

16. The method of claim 15 wherein the monitored operational parameter is selected from the group of operational parameters comprising throttle setting, tractive effort, speed, deceleration and sanding effectiveness.

17. The method of claim 8 further comprising:

monitoring an operational parameter associated with the locomotive; and automatically controlling the flow of sand applied to the least one of the rails if the second quantity of wheel slippage exceeds the second threshold value and a value of the monitored operational parameter is within a predetermined value range.

18. The method of claim 17 wherein the monitored operational parameter is selected from the group of operational parameters comprising throttle setting, tractive effort, speed, deceleration and sanding effectiveness.

19. The method of claim 17 further comprising:

measuring a sanding effectiveness at predetermined time intervals after applying sand to the rails; and reducing the flow of sand through at least one of the plurality of sand applicators if the measured sanding effectiveness is outside a desired range of sanding effectiveness.

20. The method of claim 8 wherein automatically controlling the flow of sand further comprising controlling the flow of sand in response to a geographical location of the locomotive.

21. The method of claim 8 wherein automatically controlling the flow of sand further comprising controlling the flow of sand in response to a physical characteristic of the rail.

22. The method of claim 8 wherein automatically controlling the flow of sand further comprising preventing the flow of sand in response to a geographic location of the locomotive.

23. A computer program product comprising a computer-accessible medium storing a computer program for controlling a sanding system of a locomotive, the sanding system applying sand to railroad rails to enhance adhesion of wheels of a railroad locomotive on a track, the sanding system comprising a plurality of sand applicators for directing sand flow toward the rails and with the locomotive having two trucks carrying the wheels for supporting and propelling the locomotive along the track, the computer program comprising:

a computer readable program module configured for controlling the locomotive sanding system to limit the application of sand to situations in which applying sand to at least one rail would he effective to increase the adhesion of at least one of the railroad locomotive wheels on the at least one rail by a predetermined incremental amount; and a computer readable program module configured for independently controlling the operation of the plurality of sand applicators for selectively operating those sand applicators whose operation will result in at least the predetermined incremental increase in adhesion of the locomotive wheels on the rail, while not operating the other sand applicators so as to limit the amount of sand applied to the track.

24. The computer program product of claim 23 further comprising:

a computer readable program module configured for receiving data indicative of a sanding effectiveness after a quantity of sand has been applied to the at least one rail and automatically controlling the flow of sand based on the sanding effectiveness.

25. A computer program product comprising a computer-accessible medium storing a computer program for controlling a railroad locomotive sanding system applying sand to railroad rails to enhance adhesion of wheels of a railroad locomotive on the rails, the sanding system comprising a plurality of sand applicators for directing sand flow toward the rails, the computer program comprising:

a computer readable program module configured for receiving data indicative at a first quantity of wheel slippage of the locomotive;

a computer readable program module configured for controlling a compressed air supply for applying a flow of compressed air toward the rails if the first quantity of wheel slippage exceeds a first threshold value, the flow of compressed air applied to clean the rails ahead of lead wheels of the locomotive with respect to a direction of travel of the locomotive;

a computer readable program module configured for receiving data indicative of a second quantity of wheel slippage of the locomotive; and a computer readable program module configured for controlling the locomotive sanding system for automatically controlling a flow of sand applied to at least one of the rails if the second quantity of wheel slippage exceeds a second threshold value.

26. The computer program product of claim 25 further comprising;

a computer readable program module configured for independently controlling the plurality of sand applicators so the flow of sand is applied to at least one of the rails ahead of at least one wheel of a first pair of lead wheels carried on a first truck of the locomotive with respect to a direction of travel of the locomotive.

27. The computer program product of claim 25 farther comprising:

a computer readable program module configured for receiving data indicative of a third quantity of wheel slippage of the locomotive and if the third quantity of wheel slippage exceeds a third threshold value, independently controlling the plurality of sand applicators so the flow of sand is applied to at least one of the rails ahead of at least one wheel of a first pair of lead wheels carried on a first truck of the locomotive and at least one wheel of a second pair of lead wheels castled on a second truck of the locomotive with respect to a direction of travel of the locomotive.

* * * * *